US007257925B2

(12) United States Patent
Manogue et al.

(10) Patent No.: US 7,257,925 B2
(45) Date of Patent: Aug. 21, 2007

(54) FLOOR-MOUNTED RAIL FOR A MOBILE STORAGE SYSTEM

(75) Inventors: Gary M. Manogue, Fort Atkinson, WI (US); Mark P. Haubenschild, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 10/945,374

(22) Filed: Sep. 20, 2004

(65) Prior Publication Data

US 2005/0028481 A1 Feb. 10, 2005

Related U.S. Application Data

(62) Division of application No. 10/205,761, filed on Jul. 26, 2002, now Pat. No. 6,840,022.

(51) Int. Cl.
*B66B 9/00* (2006.01)
*E04H 6/06* (2006.01)

(52) U.S. Cl. ..... 52/29; 312/201; 248/205.3; 211/162

(58) Field of Classification Search ..... 52/238.1, 52/239, 240, 241, 242, 243.1, 29, 64, 292, 52/65.7, 480, 403.1; 153/106; 312/198, 312/201; 248/429, 424, 205.36, 638, 634, 248/205.3; 211/162
See application file for complete search history.

(56) References Cited

U.S. PATENT DOCUMENTS 3,967,868 A * 7/1976 Baker, Jr. ..... 312/201
4,789,210 A * 12/1988 Weiss et al. ..... 312/201
4,911,507 A 3/1990 Leist
5,013,101 A * 5/1991 Muth ..... 312/201
5,205,627 A 4/1993 Davison et al.
5,597,217 A 1/1997 Hoska et al.
5,631,089 A 5/1997 Center et al.
5,967,346 A 10/1999 Price, Jr.
6,027,190 A 2/2000 Stewart et al.
6,112,917 A 9/2000 Baker et al.
6,158,601 A 12/2000 Baker et al.
6,308,491 B1 10/2001 Porter
6,526,702 B2 3/2003 Jones
6,669,314 B1 12/2003 Nemec et al.
2002/0157335 A1* 10/2002 Vos

* cited by examiner

*Primary Examiner*—Daniel P. Stodola
*Assistant Examiner*—Nahid Amiri
(74) *Attorney, Agent, or Firm*—Boyle Fredrickson, S.C.

(57) ABSTRACT

A system for mounting a member such as a rail to a support surface such as a floor, made of a precast concrete material, without penetrating the floor. The rail mounting system includes a base plate secured to the upper surface of the floor via an adhesive, with one or more connectors extending upwardly from the base plate. An anchor plate is secured to the rail, and adjustment screws are interconnected with the rail for adjusting the elevation of the rail relative to the base plate. When the desired elevation of the rail is attained, engagement members such as nuts are secured to the threaded connectors extending upwardly from the base plate, to fix the height of the anchor plate, and thereby the rail. A grout layer is then applied between the base plate and the anchor plate. After the grout layer is set, the leveling screws are removed and a topping layer of concrete is applied over the components of the mounting system so as to encapsulate the base plate, the anchor plate and the engagement members.

19 Claims, 6 Drawing Sheets

FLOOR-MOUNTED RAIL FOR A MOBILE STORAGE SYSTEM

CROSS-REFERENCE TO RELATED APPLICATION

This application is a divisional of application Ser. No. 10/205,761 filed Jul. 25, 2002 now U.S. Pat. No. 6,840,022.

BACKGROUND AND SUMMARY OF THE INVENTION

This invention relates to a system for mounting a member to a support surface such as a floor, for an application such as a rail associated with a mobile file or storage system, and more particularly to a mounting system in which the member is mounted to the support surface without penetrating the support surface.

In a mobile file or storage system, a series of parallel rails are mounted to a support surface such as a floor. The rails support a number of mobile carriages to which files, shelves or other storage units are mounted. The carriages are movable on the rails so as to provide high density storage in which aisles between the storage units are eliminated, in a known manner.

In a prior art construction, the rails are secured to the floor by means of a series of spaced anchors that extend into the floor. Typically, each anchor includes an upwardly extending threaded shank, which extends through an opening in one of a series of mounting plates secured to the rail. A threaded nut is engaged with each shank, and functions to clamp the plate to the floor so as to secure the rail in position on the floor. The typical prior art construction includes the use of one or more shims to level the rail at the location of each mounting plate. This type of rail mounting system is suitable for mounting a rail to a conventional concrete floor to which conventional anchors can be secured.

In some applications, a site for a mobile storage system has a floor constructed of a series of precast concrete members, which are typically low profile concrete beams with tensioned reinforcing rods or cables. Conventional anchor bolts cannot be used to mount rails to this type of floor, in that penetration of the precast member weakens its strength and runs the risk of striking the tensioned reinforcing cables or rods contained within the precast members.

It is an object of the present invention to provide a system for mounting a member such as a rail to a support surface such as a floor, without penetration of the floor. It is a further object of the invention to provide such a system which includes a feature for adjusting the elevation of the rail, so as to provide the ability to level the rail. It is a further object of the invention to provide such a system which is relatively simple in its components and which enables a rail to be mounted to a support surface in an efficient manner and with a minimal number of steps.

In accordance with the present invention, a system for mounting a member such as a rail to a support surface includes a base member, such as a base plate, which is secured to the support surface by use of an adhesive. An intermediate mounting member is secured to the rail, and the mounting member in turn is secured to the base member. The mounting member, which may be in the form of an anchor plate, is preferably secured to the base plate such that a space is defined between the base plate and the anchor plate. The mounting system includes an adjustment feature by which the dimension of the space can be varied, so as to enable the rail to be leveled. When the rail is in a desired position, a fluidic cementitious material, such as grout, is injected into the space between the base plate and the anchor plate, so as to fix the height of the anchor plate and thereby the elevation of the rail. In one form, the adjustment feature includes one or more threaded leveling screws that bear against the base plate and which are operable to vary the elevation of the anchor plate, and thereby the rail, relative to the base plate. The leveling screws are threadedly engaged with any satisfactory component, e.g. a leveling plate located between the rail and the anchor plate. To maintain the desired elevation of the rail prior to application of the grout, the anchor plate is secured in position by a retainer arrangement, e.g. retainer screws and associated engagement members such as nuts, which extends between and interconnects the base plate and the anchor plate. The retainer arrangement functions to apply downward pressure on the anchor plate, while engagement of the leveling screws with the base plate maintains the desired space between the anchor plate and the base plate. The leveling screws can then be removed after the grout is injected between the anchor plate and the base plate, and has set. A topping layer of concrete may then be applied between the rails so as to encapsulate the base plate and the anchor plate while leaving the upwardly facing portion of the rail exposed, to embed the rails within the floor.

The invention contemplates a method of mounting a member such as a rail to a support surface, as well as a mounting assembly for mounting a member such as a rail to a support surface, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
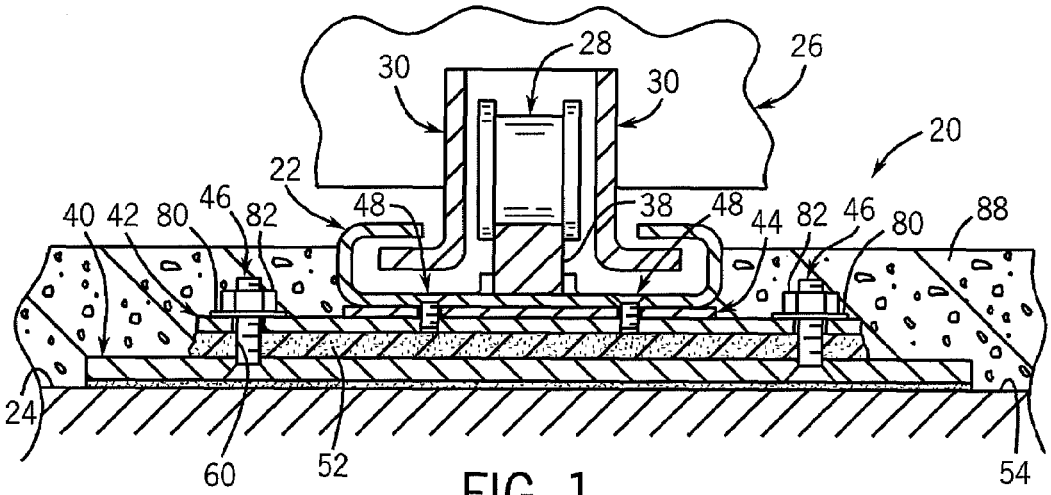
FIG. 1 is a transverse section view illustrating a mounting assembly in accordance with the present invention, for mounting a member such as a rail to a support surface such as a floor, without penetrating the surface of the floor.
Figure 2:
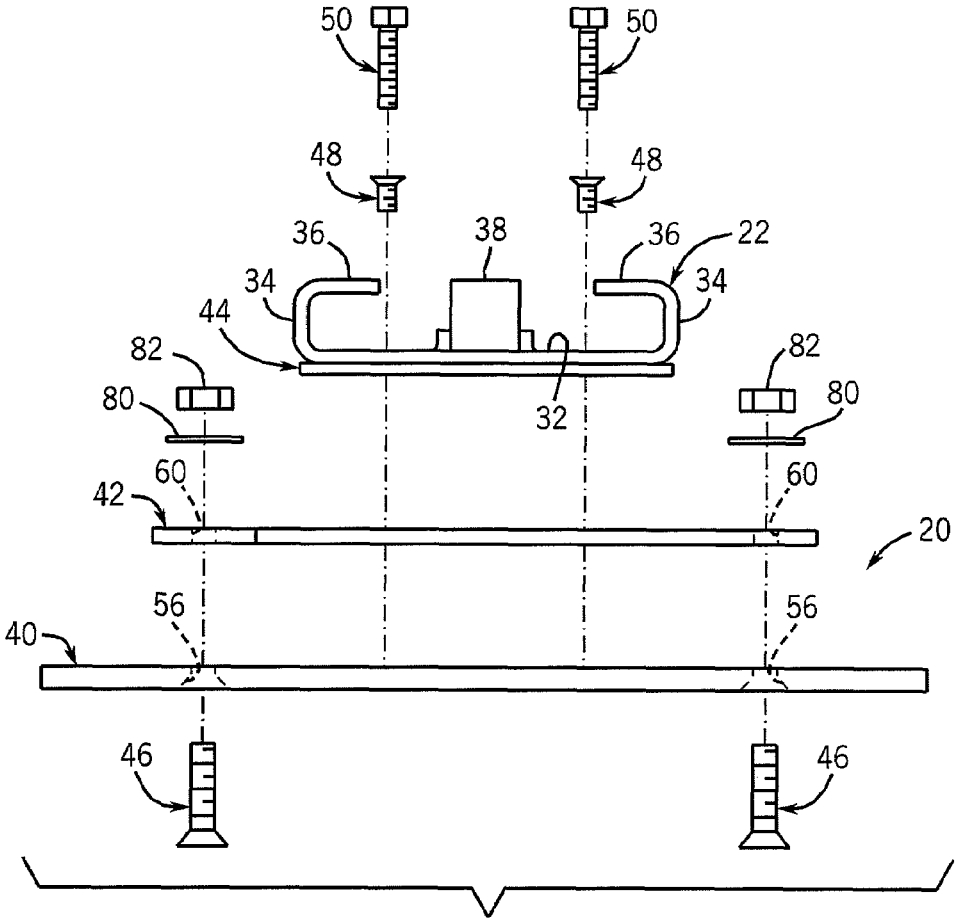
FIG. 2 is an exploded elevation view illustrating the components of the mounting system of FIG. 1.

FIGS. 1 and 2 illustrate a rail mounting assembly 20 for securing a member such as a rail 22 to a support surface 24, such as a precast concrete floor. Rail mounting assembly 20 is adapted to mount rail 22 to support surface 24 without penetrating support surface 24, as is typically required in connection with an anchor-type mounting system. Rail 22 is an elongated member which, in combination with other similar rails 22, is adapted to support a carriage 26 such as is associated with a mobile file or storage system. Typically, carriage 26 includes a series of rollers or wheels 28 in combination with anti-tip brackets 30, in a known manner. In a representative construction, rail 20 includes a bottom wall 32, a pair of side walls 34, each of which extends upwardly from one of the ends of bottom wall 32, and a lip 36 that extends inwardly from the upper end of each side wall 34. Rail 22 further includes a wheel-supporting bar 38 located between lips 36. Anti-tip brackets 30 extend downwardly into the space between bar 38 and each lip 36, in a known manner, to ensure that wheel 28 remains in engagement with bar 38 and to prevent carriage 26 from overturning, again in a known manner.

Generally, mounting assembly 20 includes a base member in the form of a base plate 40, an intermediate anchor member in the form of an anchor plate 42, and a leveling plate 44. In addition, rail mounting assembly 20 includes a pair of connectors 46 that interconnect anchor plate 42 with base plate 40, a pair of connectors 48 that secure rail 22 to leveling plate 44, and a pair of leveling screws 50 that are operable to adjust the elevation of rail 22, in a manner to be explained. A grout layer or pad 52 (FIG. 1) is located between the facing surfaces of base plate 40 and anchor plate 42. Base plate 42 40 is engaged with support surface 24 via an adhesive layer 54 located between the upwardly facing surface of support surface 24 and the downwardly facing surface of base plate 40.

Figure 3:
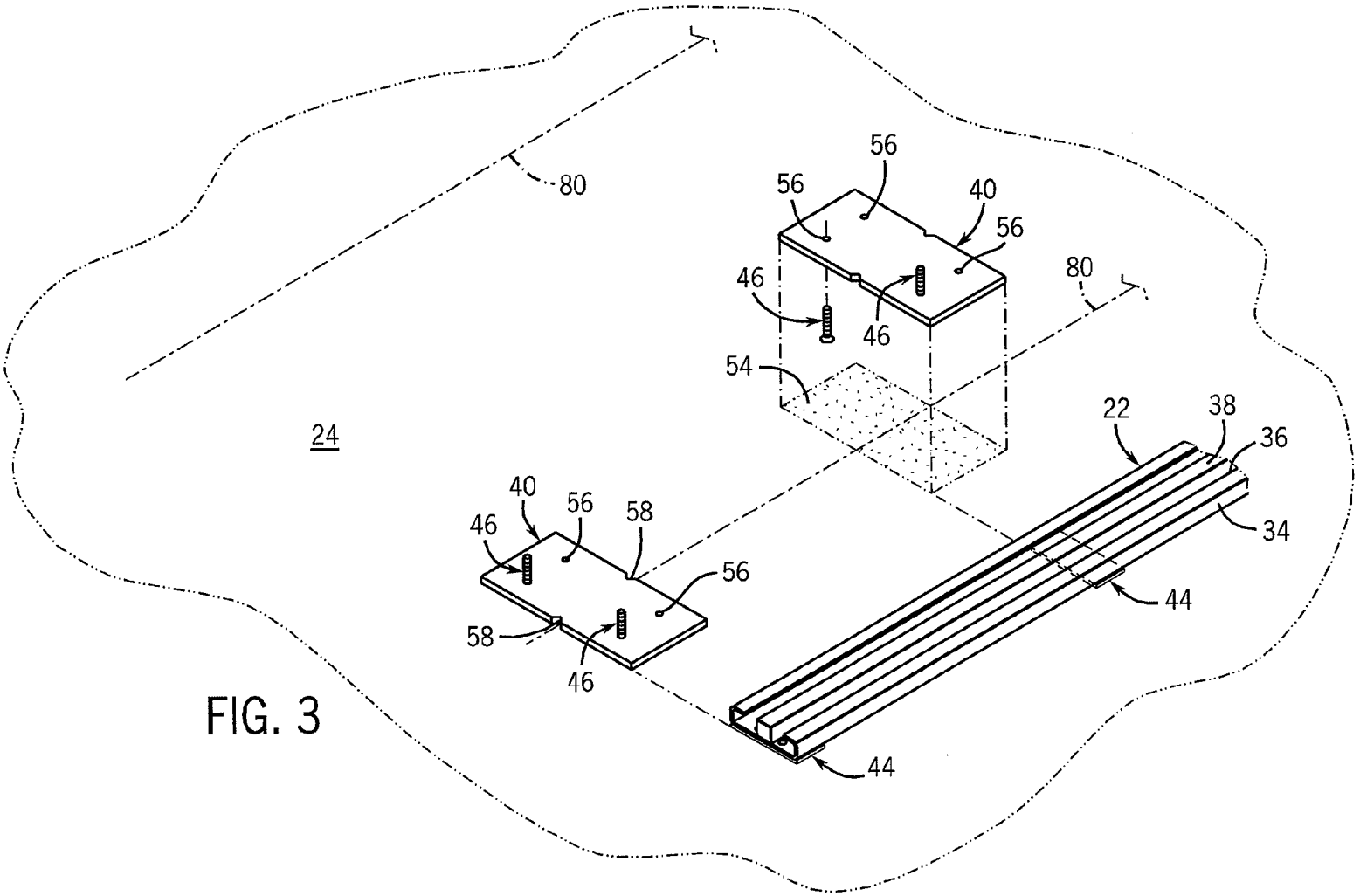
FIGS. 3-5 are isometric views illustrating the steps involved in mounting a rail to a support surface utilizing the components illustrated in FIGS. 1 and 2.
Figure 4:
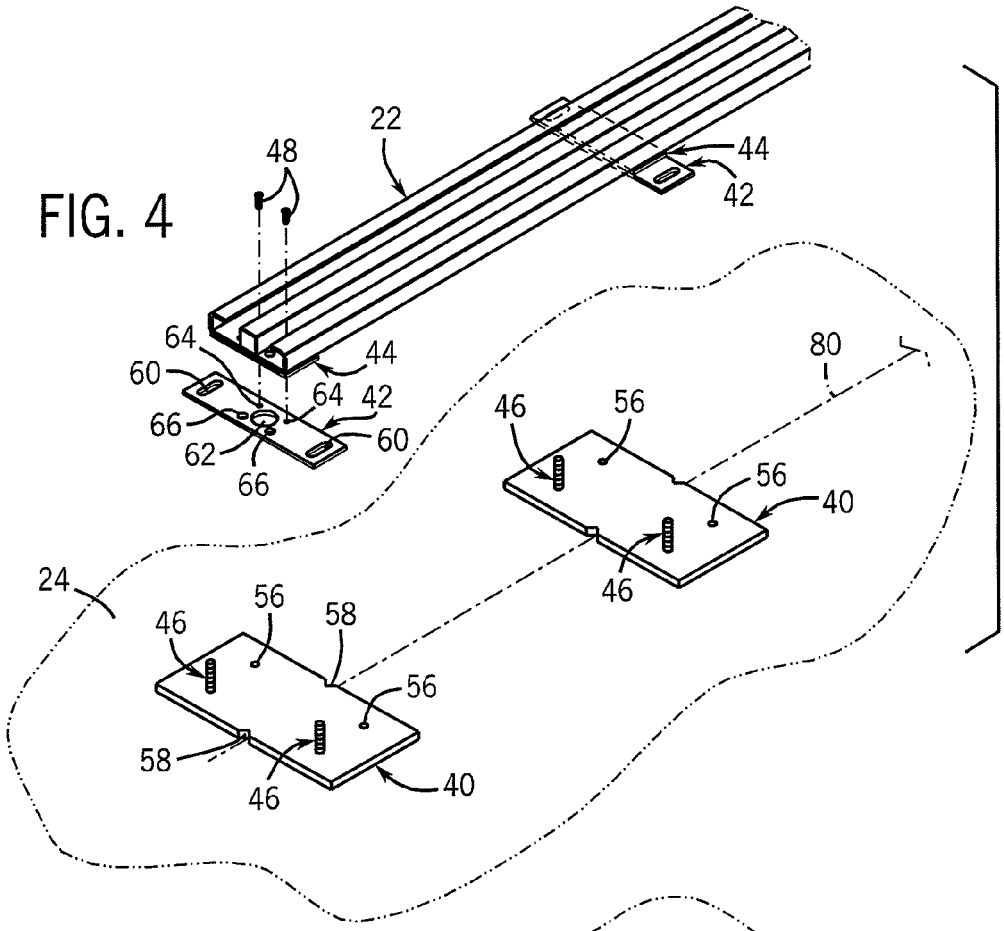
Figure 5:
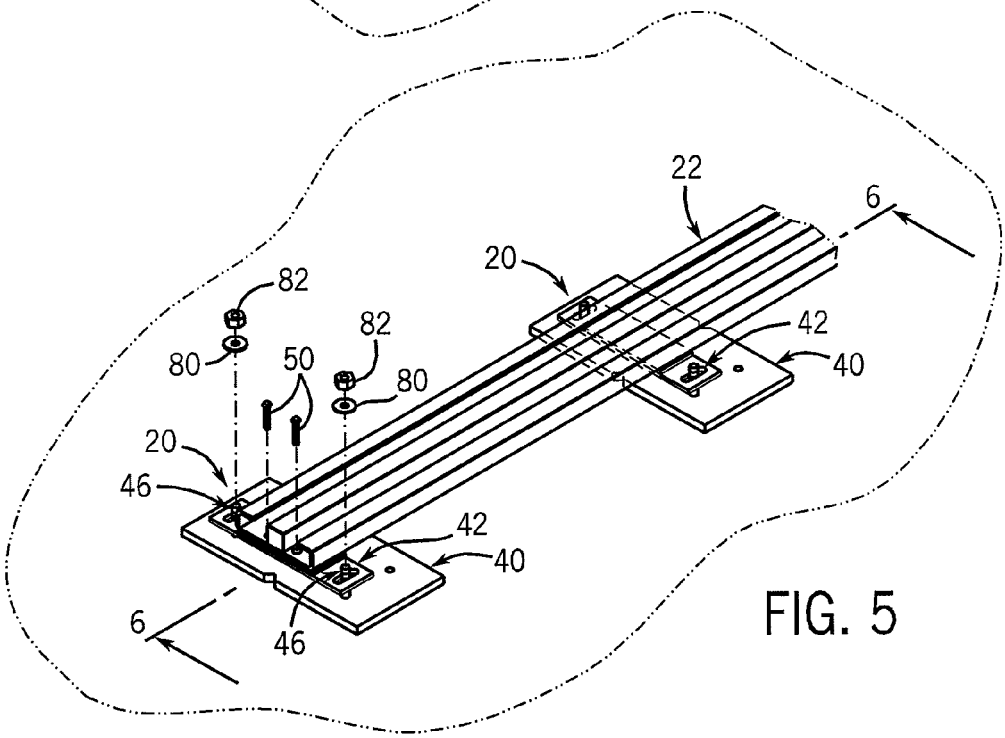

Referring to FIGS. 3-5, each base plate 40 is generally rectangular in shape, and a series of base plates 40 are positioned at spaced apart locations along the length of rail 22. Representatively, base plates 40 may be spaced evenly along the length of rail 22. Each base plate 40 includes a series of openings 56. In the illustrated embodiment, a pair of openings 56 are located on either side of the center of base plate 40. Openings 56 have a downwardly facing chamfer, which is configured so as to conform in shape to the head of each connector 46. A notch 58 is located at the center of each of the long sides of base plate 40.

Each anchor plate 42 includes a slot 60 adjacent each of its outer ends, as well as a central opening 62. A pair of threaded openings 64 and a pair of non-threaded apertures 66 are located one on either side of the center line of anchor plate 42.

Figure 6:
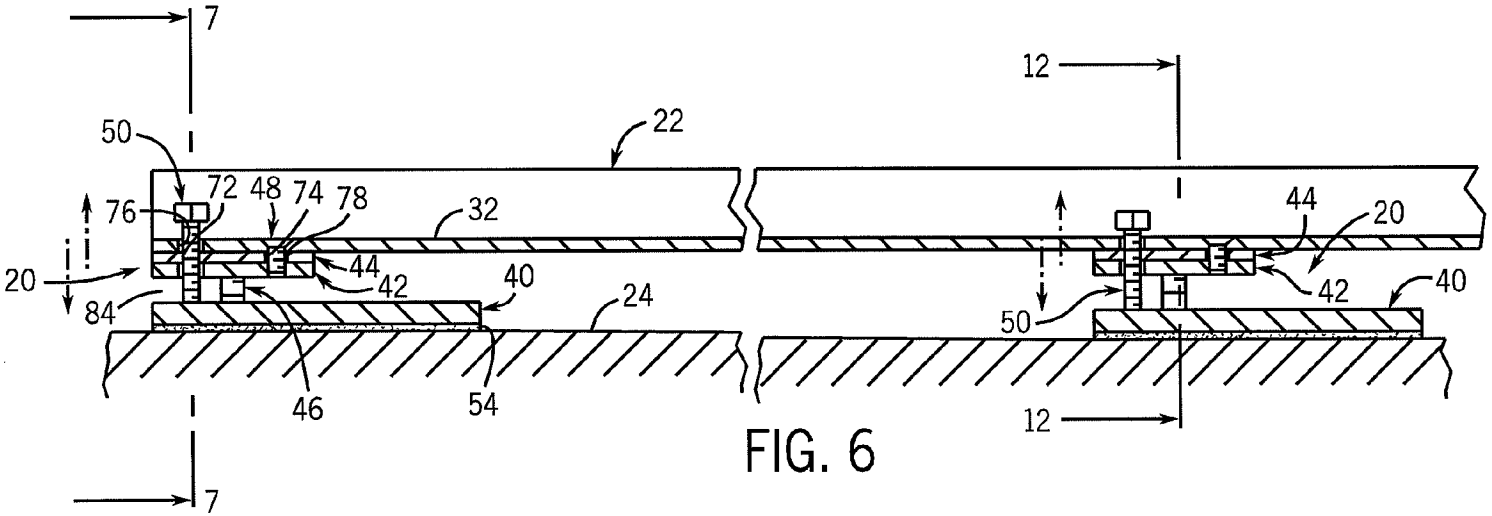
FIG. 6 is a partial section view taken along line 6-6 of FIG. 5.
Figure 7:
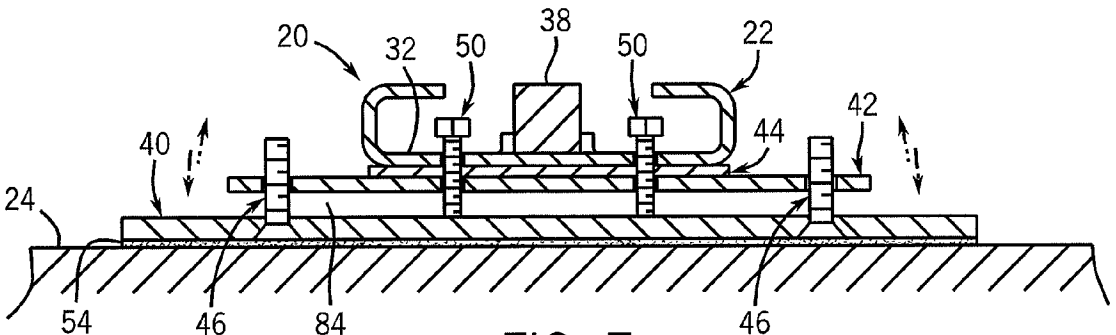
FIG. 7 is a section view taken along line 7-7 of FIG. 6.
Figure 12:
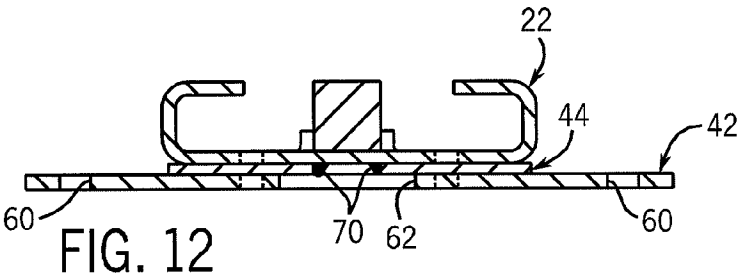
FIG. 12 is a view taken along line 12-12 of FIG. 6.

Each leveling plate 44 is secured to bottom wall 32 of rail 22, such as by welding. Leveling plate 44 includes a central opening, defining an edge which is welded at 70 (FIG. 12) to the underside of bottom wall 32 of rail 22. In addition, as shown in FIG. 6, leveling plate 44 defines a pair of threaded openings 72 and a pair of non-threaded apertures 74, located one on either side of the center line of leveling plate 44. Bottom wall 32 of rail 22 includes a non-threaded aperture 76 in vertical alignment with each threaded opening 72, as well as a chamfered opening 78 located in vertical alignment with each non-threaded aperture 74.

In order to mount each rail 22 to support surface 24, lines 80 (FIG. 3) are first applied to support surface 24 in locations corresponding to the center lines of rails 22 to be installed. Each base plate 40 is then secured to support surface 24 using adhesive layer 54, which may representatively be an epoxy-type adhesive, although it is understood that any other satisfactory type of adhesive for securing a metal member to a concrete surface may be employed. Notches 58 in base plate 40 are used to accurately position base plate 40 relative to rail center line 80. Prior to adhering base plate 40 to support surface 24, a connector 46 is engaged within each of at least one of the pairs of openings 56 in base plate 40. In a location where adjacent ends of a pair of rails 22 are to be spliced together, a connector 46 is engaged within each of the openings 56. Otherwise, one of the pairs of openings 56 is typically left empty.

Each anchor plate 42 is secured to rail 22 using connectors 48, which extend through openings 78 in rail bottom wall 32 and through non-threaded apertures 74 in leveling plate 44, into engagement with threaded openings 64 in anchor plate 42. Opening 62 in anchor plate 42 provides clearance for the material of weld 70 (FIG. 12) that extends below the downwardly facing surface of leveling plate 44, to ensure that the upwardly facing surface of anchor plate 42 comes into full contact with the downwardly facing surface of leveling plate 44.

Figure 8:
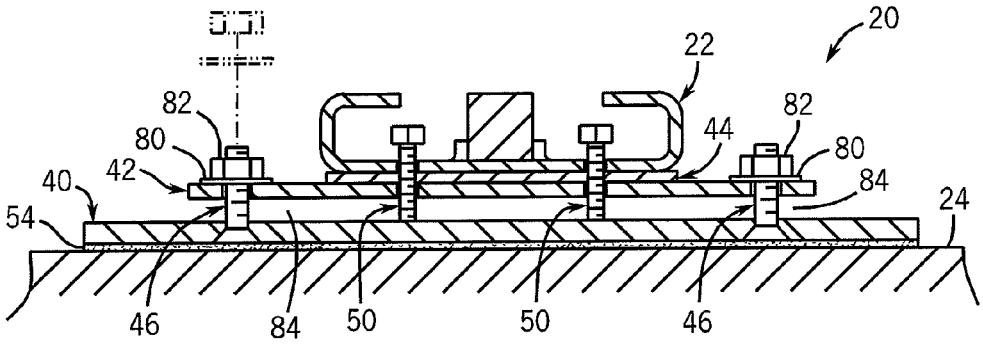
FIGS. 8-10 are views similar to FIG. 7, showing additional steps in accordance with the invention so as to secure a rail to a support surface.
Figure 9:
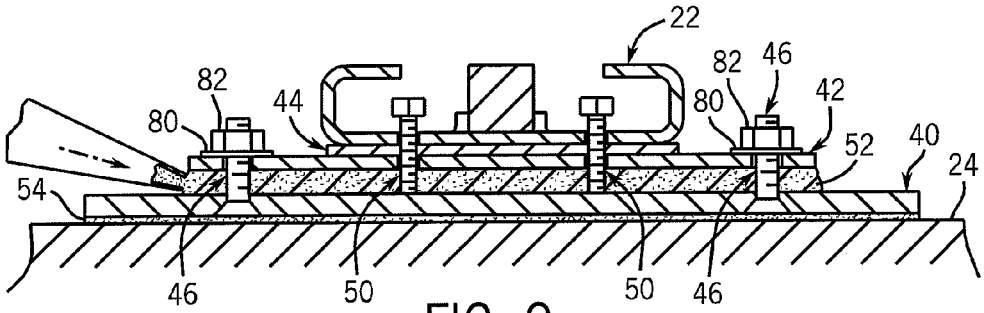
Figure 10:
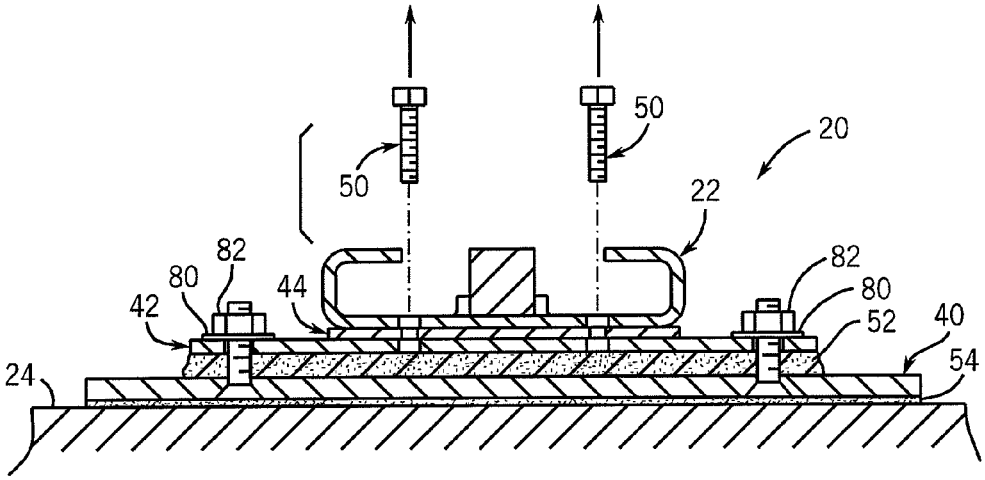

As shown in FIG. 5, rail 22 is then moved toward base plates 40 such that the threaded shank of each connector 46 extends upwardly through one of slots 60 in anchor plate 42. Leveling screws 50 are then engaged with threaded openings 72 in leveling plate 44. Each leveling screw 50 extends through a non-threaded aperture 76 in rail bottom wall 32, and through the underlying non-threaded aperture 66 in anchor plate 42. Leveling screws 50 are then rotated to advance the end of the shank of each leveling screw 50 into engagement with the upwardly facing surface of base plate 40, as shown in FIG. 6. The user rotates leveling screws 50 so as to adjust the elevation of rail 22, via the threaded engagement of the threaded shank of each leveling screw 50 within its associated threaded opening 72 in leveling plate 44. When the desired elevation of rail 22 is attained, the user places a washer 80 against the upper surface of anchor plate 42 at the location of each connector 46, and engages an engagement member, in the form of a nut 82, with the threaded shank of each connector 46. The user tightens nuts 82 down so as to apply downward pressure on anchor plate 42, which is resisted by leveling screws 50 which bear against the upper surface of base plate 40, as shown in FIG. 8. In this manner, a space 84 is defined between the downwardly facing surface of anchor plate 42 and the upwardly facing surface of base plate 40. The user then applies a fluidic cementitious setting material, such as grout, into space 84. The grout is preferably applied in a conventional grout injection process under pressure, to form grout layer or pad 52 between the downwardly facing surface of anchor plate 42 and the upwardly facing surface of base plate 40. Grout pad 52 functions to prevent downward movement of anchor plate 42, to set the elevation of anchor plate 42 and thereby rail 22. Connectors 46 and nuts 80 function to prevent upward movement of anchor plate 42 during the injection of grout into space 84 to form grout pad 52. As shown in FIG. 10, leveling screws 50 are then removed so as to clear the internal space of rail 22. A topping layer 88 (FIG. 1), which may be formed of a conventional concrete material, is then applied over support surface 24 in such a manner so as to encapsulate the components of rail mounting assembly 20, to embed rail 22 within the floor formed by topping layer 88.

Figure 11:
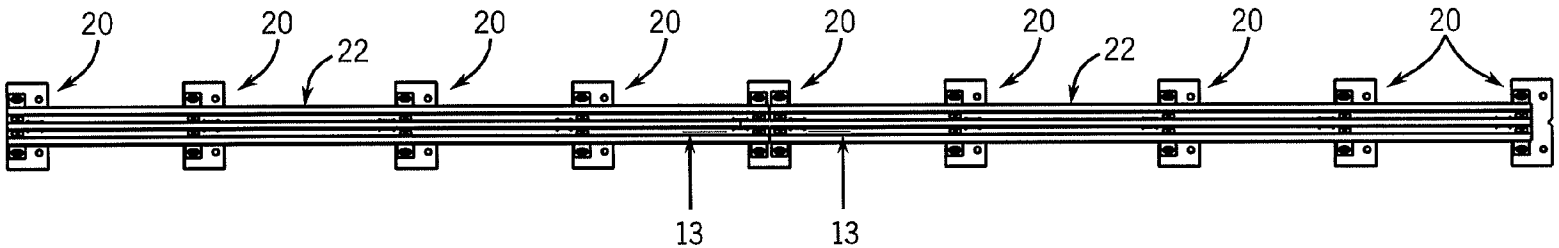
FIG. 11 is a top plan view showing a series of rail mounting assemblies as in FIG. 1 for mounting a pair of aligned rails to a support surface.
Figure 13:
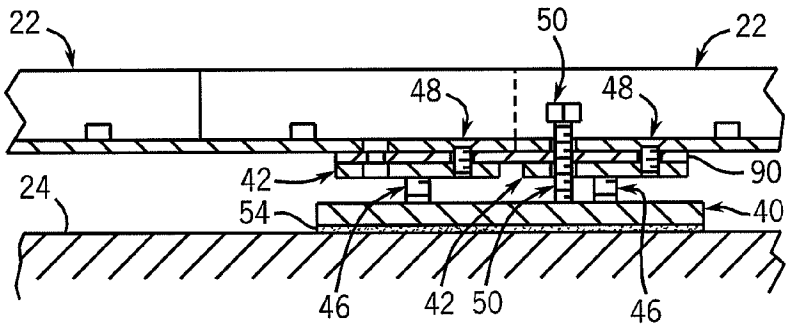
FIG. 13 is a partial section view taken along line 13-13 of FIG. 11, illustrating a splice between adjacent rail sections.

As shown in FIG. 11, a number of rail mounting assemblies 20 are provided along the length of each section of rail 22. This enables rail 22 to be leveled at the location of each rail mounting assembly 20, so that rail 22 can be leveled along its length. At a joint between adjacent rail sections 22, an elongated leveling plate 90 (FIG. 13) is employed to connect the ends of rails 22 together in an end-to-end relationship, and to ensure that the rail ends are at the same elevation.

It can thus be appreciated that each rail mounting assembly 20 provides an arrangement for mounting a member such as a rail to a floor or other supporting surface, without the need to penetrate the floor or supporting surface. The rail is securely mounted in a manner so that the rail is maintained in position within the floor at the desired elevation.

While the invention has been shown and described with respect to a particular embodiment, it is contemplated that numerous variations and alternatives are possible and are considered to be within the scope of the present invention. For example, and without limitation, each base member and each intermediate or anchor member may have a plate-like configuration as shown, or may have any other desired shape or configuration. In addition, any number of rail mounting assemblies 20 may be provided along the length of the rail. Further, while threaded connectors are illustrated as interconnecting the anchor plate with the base plate, it is understood that any other satisfactory type of variable position connection may be employed so as to secure the anchor plate in position relative to the base plate once the rail has been positioned in the desired elevation. For example, and without limitation, threaded connectors may extend downwardly from the anchor plate into engagement within threaded openings in the base plate to fix the vertical position of the anchor plate, and thereby the rail, relative to the base plate once the rails are placed at the desired elevation. Further, any other type of arrangement for leveling the rail relative to the base plate may be employed in place of the threaded leveling members as shown and described, so long as the dimension of the space between the base plate and the anchor plate can be adjusted while maintaining the anchor plate in position relative to the base plate when the grout layer is applied. This includes the use of shims or the like placed within the space between the base plate and the anchor plate, to adjust the elevation of the anchor plate and thereby the rail. While the invention has been shown and described in connection with rails associated with a mobile storage system, it is understood that the present invention may be used to secure any type of item or member to a floor or other support surface in any application.

Various alternatives and embodiments are contemplated as being within the scope of the following claims particularly pointing out and distinctly claiming the subject matter regarded as the invention.

We claim:

1. A mounting assembly for mounting a rail to a support surface without penetrating the support surface, comprising:

a rail;

a base member adapted to be mounted to the support surface via an adhesive located between facing surfaces defined by the base member and the support surface;

a height adjustment arrangement between the rail and the base member for varying the elevation of the rail relative to the base member; and a variable position securement arrangement between the rail and the base member, wherein the variable position securement arrangement is separate from the height adjustment arrangement and is configured and arranged to secure the rail to the base member, after the rail is positioned in a desired elevation using the height adjustment arrangement so as to fix the elevation of the rail relative to the base member, wherein the variable position securement arrangement includes one or more securing members that are movable into engagement with the rail after the rail is positioned in the desired elevation using the height adjustment arrangement and that are configured and arranged to prevent vertical movement of the rail when engaged with the rail, to thereafter prevent adjustment in the height of the rail by operation of the height adjustment arrangement.

2. The mounting assembly of claim 1, further comprising an intermediate mounting member to which the rail is secured, wherein a space is defined by the height adjustment arrangement between the intermediate mounting member and the base member.

3. The mounting assembly of claim 2, wherein the space between the intermediate mounting member and the base member is variable upon operation of the height adjustment arrangement to vary the elevation of the rail relative to the support surface, and wherein the one or more securing members of the variable position securement arrangement are operable to fix the elevation of the intermediate mounting member subsequent to operation of the height adjustment arrangement, to thereby fix the elevation of the rail relative to the base member.

4. A mounting assembly for mounting a rail to a support surface without penetrating the support surface, comprising:

a rail;

a base member adapted to be mounted to the support surface via an adhesive located between facing surfaces defined by the base member and the support surface;

an intermediate mounting member secured to the rail, wherein the intermediate mounting member is engaged with the base member to secure the rail in position relative to the support surface, wherein a space is defined between the intermediate mounting member and the base member;

one or more leveling members associated with the rail, each of which includes an end engaged with the base member for varying the elevation of the rail relative to the base member, and thereby varying the dimension of the space between the mounting member and the base member;

wherein the mounting member is engaged with the base member via one or more threaded retainer members that extend between the base member and the mounting member and through the space therebetween for maintaining the position of the mounting member relative to the base member, and further comprising a fluidic setting material located within the space between the mounting member and the base member for maintaining the elevation of the rail.

5. A system for mounting a member to a support surface, comprising:

a member;

a base secured to the support surface via an adhesive, wherein the base has an upwardly facing surface; and variable height engagement means for engaging the member with the base and for enabling the elevation of the member relative to the support surface to be varied, wherein the variable height engagement means comprises an anchor member to which the member is secured, a height adjustment arrangement interposed between the anchor member and the base, and a variable position securement arrangement between the anchor member and the base, wherein the variable position securement arrangement is separate from the height adjustment arrangement and is configured and arranged to secure the rail to the base member after the rail is positioned in a desired elevation using the height adjustment arrangement so as to fix the elevation of the member relative to the base, after the member is positioned in a desired elevation using the height adjustment arrangement, wherein the variable height engagement means includes one or more securing members that movable into engagement with the rail after the rail is positioned in the desired elevation using the height adjustment arrangement, and wherein the one or more securing members are configured and arranged to prevent vertical movement of the rail when engaged with the rail, to thereafter prevent adjustment in the height of the rail by operation of the height adjustment arrangement.

6. The system of claim 5, wherein the height adjustment arrangement is operable to locate the anchor member and the member at a desired elevation, wherein a space is defined between the anchor member and the upwardly facing surface of the base, and further comprising a fluidic setting material located within the space so as to maintain the position of the anchor member and the member relative to the base.

7. A system for mounting a member to a support surface, comprising:

a member;

a base secured to the support surface via an adhesive, wherein the base has an upwardly facing surface;

variable height engagement means for engaging the member with the base and for enabling the elevation of the member relative to the support surface to be varied, wherein the variable height engagement means comprises an anchor member to which the member is secured, a height adjustment arrangement interposed between the anchor member and the base, and a variable position engagement arrangement between the anchor member and the base, wherein the variable position engagement arrangement is separate from the height adjustment arrangement and is configured and arranged to fix the elevation of the member relative to the base, and to secure the anchor member to the base, after the member is positioned in a desired elevation using the height adjustment arrangement, wherein the height adjustment arrangement comprises one or more threaded height adjustment members interconnected with the member and engageable with the upwardly facing surface of the base, wherein rotation of the one or more threaded height adjustment members functions to adjust the elevation of the member relative to the base, and wherein a space is defined between the anchor member and the upwardly facing surface of the base; and a fluidic setting material located within the space so as to maintain the position of the anchor member and the member relative to the base.

8. A system for mounting a member to a support surface, comprising:

a member;

a base secured to the support surface via an adhesive, wherein the base has an upwardly facing surface;

variable height engagement means for engaging the member with the base and for enabling the elevation of the member relative to the support surface to be varied, wherein the variable height engagement means comprises an anchor member to which the member is secured, a height adjustment arrangement interposed between the anchor member and the base, and a variable position engagement arrangement between the anchor member and the base, wherein the variable position engagement arrangement is separate from the height adjustment arrangement and is configured and arranged to fix the elevation of the member relative to the base, and to secure the anchor member to the base, after the member is positioned in a desired elevation using the height adjustment arrangement, wherein the height adjustment arrangement is operable to locate the anchor member and the member at a desired elevation, wherein a space is defined between the anchor member and the upwardly facing surface of the base; and a fluidic setting material located within the space so as to maintain the position of the anchor member and the member relative to the base;

wherein the variable position engagement arrangement comprises retainer means for maintaining the position of the anchor member and the member upon placement of the fluidic setting material into the space between the anchor member and the upwardly facing surface of the base.

9. The system of claim 8, wherein the retainer means comprises one or more threaded fasteners interconnected with and extending upwardly from the base and through one or more openings associated with the anchor member, and an engagement member threadedly engaged with each of the threaded fasteners so as to prevent upward movement of the anchor member.

10. The system of claim 9, wherein the height adjustment arrangement engages the upwardly facing surface of the base member so as to maintain the elevation of the anchor member and the member relative to the base, and wherein the one or more threaded fasteners and the associated threaded engagement members are operable to apply downward pressure on the anchor member such that the height adjustment arrangement and the one or more threaded fasteners are operable to fix the position of the anchor member relative to the base.

11. A mounting assembly for mounting a rail to a support surface without penetrating the support surface, comprising:

a rail;

a base member adapted to be mounted to the support surface via an adhesive located between facing surfaces defined by the base member and the support surface;

a height adjustment arrangement between the rail and the base member for varying the elevation of the rail relative to the base member; and a variable position engagement arrangement between the rail and the base member, wherein the variable position engagement arrangement is separate from the height adjustment arrangement and is configured and arranged to fix the elevation of the rail relative to the base member, and to secure the rail to the base member, after the rail is positioned in a desired elevation using the height adjustment arrangement, wherein the variable position engagement arrangement comprises one or more threaded members that extend between and interconnect the intermediate mounting member and the base member to secure the rail to the base member after the rail is positioned in a desired elevation using the height adjustment arrangement.

12. The mounting assembly of claim 11, wherein the height adjustment arrangement comprises one or more threaded leveling members associated with the rail, each of which includes an end engaged with the base member for varying the elevation of the rail relative to the base member, and thereby varying the dimension of the space between the mounting member and the base member.

13. The mounting assembly of claim 12, further comprising a fluidic setting material located within the space between the mounting member and the base member for maintaining the elevation of the rail.

14. A system for mounting a member to a support surface, comprising:

a member;

a base adapted to be secured to the support surface via an adhesive, wherein the base has an upwardly facing surface;

variable height engagement means for engaging the member with the base and for enabling the elevation of the member relative to the support surface to be varied, wherein the variable height engagement means comprises an anchor member to which the member is secured, and a height adjustment arrangement interposed between the anchor member and the base, wherein the height adjustment arrangement is operable to locate the anchor member and the member at a desired elevation, wherein a space is defined between the anchor member and the upwardly facing surface of the base; and a fluidic setting material located within the space so as to maintain the position of the anchor member and the member relative to the base.

15. The system of claim 14, wherein the height adjustment arrangement comprises one or more threaded height adjustment members interconnected with the rail and engageable with the upwardly facing surface of the base, wherein rotation of the one or more threaded height adjustment members functions to adjust the elevation of the member relative to the base.

16. The system of claim 15, further comprising retainer means for maintaining the position of the anchor member and the member upon placement of the fluidic setting material into the space between the anchor member and the upwardly facing surface of the base.

17. The system of claim 16, wherein the retainer means comprises one or more threaded fasteners interconnected with and extending upwardly from the base and through one or more openings associated with the anchor member, and an engagement member threadedly engaged with each of the threaded fasteners so as to prevent upward movement of the anchor member.

18. The system of claim 17, wherein the height adjustment arrangement engages the upwardly facing surface of the base so as to maintain the elevation of the anchor member and the member relative to the base, and wherein the one or more threaded fasteners and the associated threaded engagement members are operable to apply downward pressure on the anchor member such that the height adjustment arrangement and the one or more threaded fasteners are operable to fix the position of the anchor member relative to the base.

19. A mounting assembly for mounting a rail to a support surface such as a floor without penetrating the support surface, comprising:

a rail;

a base member adapted for mounting to the support surface via an adhesive located between facing surfaces defined by the base member and the support surface;

a height adjustment arrangement between the rail and the base member for varying the elevation of the rail relative to the base member, wherein the height adjustment arrangement comprises one or more threaded leveling members associated with the rail, each of which includes an end engaged with the base member for varying the elevation of the rail relative to the base member, and thereby varying the dimension of a space between the mounting member and the base member;

a variable position engagement arrangement between the base member and the rail, wherein the variable position engagement arrangement is configured and arranged to secure the rail to the base member after the rail is positioned in a desired elevation using the height adjustment arrangement, wherein the variable position engagement arrangement comprises one or more threaded members that extend between and interconnect the intermediate mounting member and the base member to secure the rail to the base member; and a fluidic setting material located within the space between the mounting member and the base member for maintaining the elevation of the rail.

* * * * *